US005339909A

United States Patent [19]

Jenne et al.

[11] Patent Number: 5,339,909

[45] Date of Patent: Aug. 23, 1994

[54] APPARATUS FOR MAKING EARTH BORES

[75] Inventors: Gustav Jenne, Essen, Fed. Rep. of Germany; Dietmar Jenne, Strengelbach, Switzerland

[73] Assignee: Terra AG Fuer Tiefbautechnik, Strengelbach, Switzerland

[21] Appl. No.: 983,656

[22] Filed: Dec. 1, 1992

[30] Foreign Application Priority Data

Dec. 20, 1991 [DE] Fed. Rep. of Germany ..... 4142343

[51] Int. Cl.[5] ..... E21B 11/02

[52] U.S. Cl. ..... 175/22; 175/295

[58] Field of Search ..... 175/21, 22, 23

[56] References Cited

U.S. PATENT DOCUMENTS

| | | | |
|---|---|---|---|
| 1,906,706 | 5/1933 | Moore | 175/23 |
| 2,126,576 | 8/1938 | Ranney | 175/21 |
| 3,151,687 | 10/1964 | Sato et al. | 175/21 |
| 3,221,558 | 12/1965 | Lagergren | 175/21 |
| 3,659,536 | 5/1972 | White | 175/21 |
| 3,934,659 | 1/1976 | Tsiferov . | |
| 3,945,444 | 3/1976 | Knudson . | |
| 4,133,395 | 6/1979 | Schmidt | 175/22 |
| 4,700,776 | 10/1987 | Petrovic | 175/21 |
| 4,732,222 | 3/1988 | Schmidt | 175/22 |
| 4,749,050 | 6/1988 | Ritter | 175/21 |

FOREIGN PATENT DOCUMENTS

| | | |
|---|---|---|
| 0392237 | 10/1990 | European Pat. Off. . |
| 2924393 | 12/1980 | Fed. Rep. of Germany . |
| 3226568 | 1/1984 | Fed. Rep. of Germany . |
| 3818998 | 12/1989 | Fed. Rep. of Germany . |
| 289073-A5 | 4/1991 | Fed. Rep. of Germany . |
| 2126267 | 3/1984 | United Kingdom . |

OTHER PUBLICATIONS

Tunnel, Feb. 1991, pp. 90 and 91.

Erdöl und Kohle-Erdgas-Petrochemie vereingt mit Brennstoff-Chemie, Bd. 44, Jun. 1991, p. 232.

Neue Bergbautechnik, 20 Jg., Heft 4, Apr. 1991 p. 137.

Brunnenbau, Bau von Wasserwerken und Rohrleitungsbau, Mar. 1991, pp. 1101 ∝ 114.

*Primary Examiner*—Ramon S. Britts

*Assistant Examiner*—Frank S. Tsay

[57] ABSTRACT

An apparatus for making earth bores with simultaneous emplacement of pipe, especially for making well bores, includes an earth boring device (10) with a drive device (12) and a displacement head (14) coaxial with the drive device (12). The outer diameter of the displacement head is larger than that of the drive device (12) and of the surrounding pipe (16) with the pipe being connected to the drive device with a releasable force fit connection, wherein at least three pressure fluid jet nozzles (18) are arranged on the displacement head (14) pointing nearly in the boring direction and arranged at least nearly symmetrical to the longitudinal axis of the displacement head (14).

15 Claims, 2 Drawing Sheets

APPARATUS FOR MAKING EARTH BORES

Figure 1:
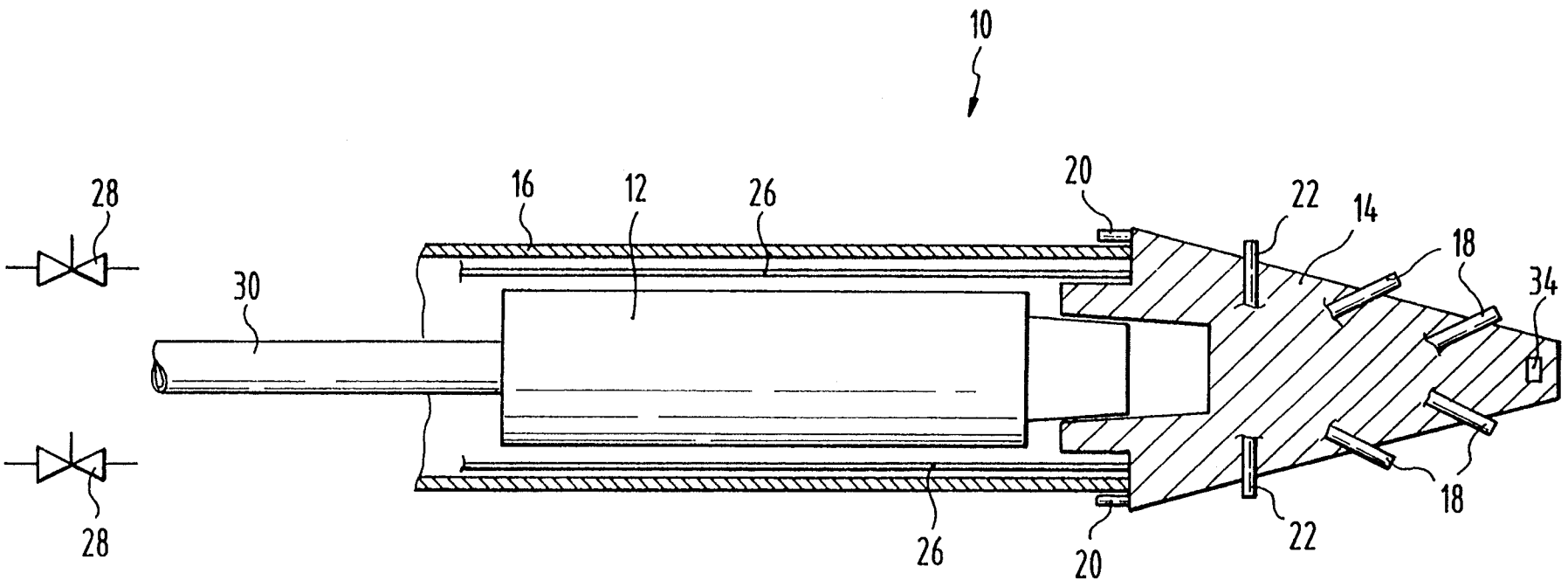

The invention concerns an apparatus for making earth bores according to the preamble of claim 1.

For the making of vertical, horizontal or inclined displacement bores ram boring devices (earth displacement hammers, earth rockets) are customarily used in combination with large displacement heads, in order to be able to simultaneously emplace for the well or other connection a pipe, used mostly in the water drainage area, of steel, plastic, cement or other material.

For the simultaneous emplacement of these pipes or protection tubes with the displacement boring process the conical displacement head is arranged on the front of the pipe to be emplaced, with the maximum diameter of the displacement head being somewhat larger than the diameter of the pipe. Such a displacement head makes the necessary bore hole along the path of the earth displacement. Thus earth is not removed but instead is displaced radially outwardly into the pores of the surrounding subsoil. In order to insert the displacement head along with the following pipe into the earth either a static pushing force (hydraulic press or attached weight) or a dynamic ram boring device (ram hammer, rapid blow hammer) is applied by a force fit connection to the displacement head. In regard to this, it is desirable that an air pressure or oil driven dynamic ram boring device whose outer diameter is somewhat smaller than the inner diameter of the emplaced pipe have a releasable force fit connection with the displacement head arranged on the front of the pipe. It is thereby assured that the ram blows are converted free of loss and over a short path into earth displacements and create a bore hole into which the pipe can be easily brought. When in the case of a well bore the bore hole has reached the desired insertion depth the force fit connection between the displacement head and the drive apparatus is disconnected and the drive device is withdrawn inside of the pipe. In the case of a dynamic ram boring device or rapid blow hammer this customarily is done by switching the device or hammer to reverse operation.

At the same time, it is above all disadvantageous that a relatively small ram boring device must displace a relatively large cross section since the displacement head necessarily is clearly larger than the diameter of the ram boring device. Therefore, above all vertical bores, for example for the making of wells, largely cannot be executed with good results, since especially in the case of vertical work several layers of earth, including in part hard earth layers, have to be passed through.

A further disadvantage consists in that especially in the case of boring wells the water permeability of the subsoil is reduced in the vicinity of the bore hole, since the displaced earth closes pores and channels through which the water should flow to the well bore.

The invention therefore has as its object the provision of a device of the aforementioned kind which significantly reduces by technically simple means the displacement or head resistance in the boring process.

This object is solved in accordance with the invention by an apparatus for making earth bores with the simultaneous emplacement of pipe, especially for making well bores, including an earth boring device with a drive device and a displacement head arranged coaxial to the drive device, the outer diameter of which displacement head is larger than the outer diameter of the drive device and of the pipe which surrounds the drive device and whose force fit connection with the drive device is made so as to be releasable, with the displacement head in accordance with the invention having arranged on it at least one fluid jet nozzle pointing at least nearly in the boring direction and arranged nearly symmetrically to the longitudinal axis of the displacement head and connectable to a fluid pressure source. In the case of only one jet nozzle this means that it is arranged at the point of the displacement head at least nearly on the longitudinal axis itself.

With the help of the apparatus of the invention in a boring procedure it is possible to break up the region of earth located in front of the displacement head by means of the pressure fluid emitted by the pressure fluid jet nozzles, which makes necessary a substantially lower energy for the advancement of the earth boring device, since in the broken up area of the earth the displacement head encounters a reduced resistance at its point.

The fluid pressure can be varied between about 10 to 300 bar in accordance with the type of earth involved. In order to facilitate the advancement of the earth boring device by an improvement of its sliding properties, a pressure fluid can be used which has thixotropic or lubricating properties. Further, additives to the boring fluid, for example polymers, can substantially reduce the friction between the pipe to be emplaced and the earth so that larger lengths and depths are possible.

In order to be able to break up a large surface area of the earth, if need be, it is practical to arrange a plurality of fluid jet nozzles behind one another in the longitudinal direction of the displacement head. This effect can be amplified if the fluid jet nozzles have different jet angles in the longitudinal direction of the displacement head.

For well bores it is especially advantageous if the displacement head has supplemental fluid jet nozzles which are directed at least nearly oppositely to the boring direction, since thereby the already displaced earth is broken up and its water permeability improved. A further improvement of this effect can be achieved in that further fluid jet nozzles are arranged on the displacement head which are directed outwardly perpendicularly to the longitudinal axis of the earth boring device.

In accordance with a further advantageous embodiment of the invention a directional control of the earth boring device is possible in that the pressure fluid to each fluid jet nozzle is individually controlled with respect to the pressure and/or amount of the pressure fluid. By the choice of the fluid jet nozzles to which pressure fluid is applied and/or the choice of the pressure the degree of breaking up of the earth in a given angular area around the displacement head of the earth boring device can be so achieved that by means of this breaking up a large or small directional change of the earth boring device can be achieved, since in the broken up area of the earth the resistance opposing the displacement head of the earth boring device is reduced and the displacement head of the earth boring device consequently deviates toward the side of the lowered resistance. The same effect can be achieved in that the jet angle of the individual fluid jet nozzles is adjustable.

The displacement head of the earth boring device can, except for the arrangement of the fluid jet nozzles, be formed in customary ways. For example the displacement head can have a conical shape and can have grooves distributed over the cone surface symmetrically with respect to the longitudinal axis, in which grooves the fluid jet nozzles are arranged. In contrast to this simple displacement head the displacement head can also be stepped and likewise have grooves distributed symmetrically to the longitudinal axis, in which grooves the fluid jet nozzles are again arranged. By the arrangement of the fluid jet nozzles in the grooves these are protected against abrasion and eventual destruction. The stepped displacement head has better crushing properties since the stepped surfaces can exert a higher pressure.

The pressure fluid delivery to the individual fluid jet nozzles is practically arranged parallel to the axis of the earth boring device either in the housing wall of the drive device or between the housing and the pipe to be emplaced. The channels for the pressure fluid delivery at their ends remote from the head are connected with a pressure fluid source through flexible conductors.

The control valves for controlling the pressure fluid delivery to the individual fluid jet nozzles can be provided either in the displacement head itself or at the pressure fluid source. The latter embodiment has the advantage that the control conductors for controlling the control valves are short and need not be pulled along with the earth boring device.

For determining and supervising the position and alignment of the earth boring device a sender can be provided in the displacement head which emits the desired and suitable position signals.

In order to make possible the use underwater of an earth boring device formed as a dynamic ram boring device, it is practical, if the exhaust of the pneumatic ram device is discharged rearwardly through a watertight conductor.

Figure 2:
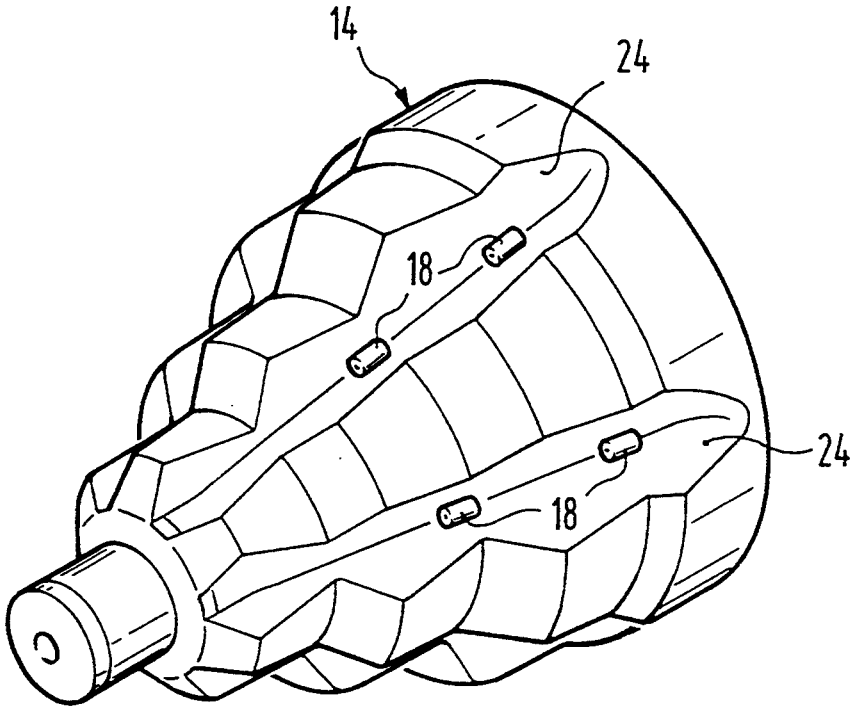
Figure 3:
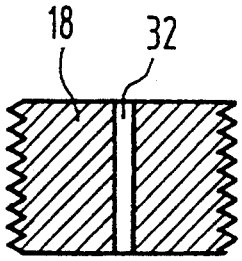
Figure 4:
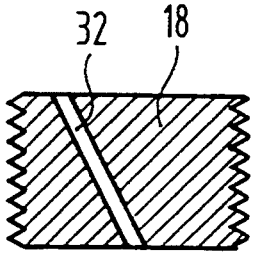

Further features and advantages will be apparent from the following description which in connection with the accompanying drawings explain the invention by way of several exemplary embodiments. The drawings are:

FIG. 1 A cross section through an earth boring device according to a first embodiment and containing its longitudinal axis, FIG. 2 A perspective view of a displacement head according to a further embodiment of the invention, FIGS. 3 and 4 Are each a schematic cross sectional representation of a respective fluid jet nozzle.

An earth boring device, indicated generally at 10, is shown in FIG. 1 and consists of a rapid blow hammer 12 and a displacement head 14, with the help of which a bore or tunnel can be made in the ground, into which a pipe 16 is inserted simultaneously with the boring procedure.

The displacement head 14 illustrated in FIG. 1 has several fluid jet nozzles 18 directed nearly in the boring direction, which nozzles serve to break up the earth in front of the displacement head 14.

Since it is especially necessary in the boring of wells that the displaced earth be broken up to increase and reestablish its water permeability the displacement head 14 illustrated in FIG. 1 includes additional fluid jet nozzles 20 and further fluid jet nozzles 22 which are directed nearly opposite to the boring direction and perpendicularly to the longitudinal axis of the boring device 10.

In the embodiment illustrated in FIG. 1, between the housing of the rapid blow hammer 12 and the inner wall of the emplaced pipe 16 are arranged several channels 26 parallel to the longitudinal axis of the earth boring device 10. These channels 26 at their ends remote from the head are connected by flexible conductors with a non-illustrated fluid pressure source.

The delivery to the individual fluid jet nozzles 18, 20 and 22 is controlled by control valves 28 schematically indicated in FIG. 1. With these control valves 28 the amount and/or the pressure of the pressure fluid supplied to the individual fluid jet nozzles 18, 20 and 22 can be individually adjusted, in order to establish the above-described direction control of the earth boring device 10.

The pressurized air delivery for the rapid blow hammer 12 takes place through the hose 30.

FIG. 2 shows a stepped displacement head 14, having better crushing properties for use in hard and stone containing ground. This displacement head 14 has grooves 24 arranged symmetrically to its longitudinal axis in each of which, in the illustrated case and by way of example, two fluid jet nozzles 18 are arranged behind one another and whose jet angles can be chosen to be similar or dissimilar to one another in order to increase the control possibilities. The fluid jet nozzles 18 in one groove 24 can be connected in common to one pressure fluid conductor or can be connected to separate pressure fluid conductors.

A fluid jet nozzle 18 is illustrated in FIGS. 3 and 4 which is formed as a slotted screw threadable into an associated jet opening, with a jet channel 32 extending through the screw. In the case of the fluid jet nozzle 18 of FIG. 3 the jet channel 32 is axially directed, whereas in the embodiment of FIG. 4 the jet channel 32 forms an angle with the axis of the screw. By the threading in of fluid jet nozzles 18 with jet channels 32 of different form the jet angles of the fluid jet nozzles 18 can be adjusted. Also in the case of a slantingly directed jet channel 32, by a rotation of the fluid jet nozzle 18 the jet direction can be changed.

In the preceding description a ram boring device has been described as an exemplary embodiment. The breaking up of the ground as well as the control of a boring device with the help of fluid jet nozzles arranged on the displacement head and by means of the pressure fluid ejected from the jets is applicable not only to ram boring devices but can also be used in a static earth boring device. Such static earth boring device is not driven forwardly by the ram impulses of a rapid blow hammer but is driven forwardly by a forward pushing pressure applied through a rod. Otherwise, however, the above-described realizations of the previously described ram bore device apply in similar ways for a static earth boring device.

In all exemplary embodiments a sender 34 can be arranged in the displacement head 14 of the earth boring device 10, as illustrated schematically in FIG. 1, which makes possible a trouble-free determination of the position of the earth boring device 10.

We claim:

1. An apparatus for making earth bores with simultaneous emplacement of a pipe having a front end, inside and outside diameters and a longitudinal axis, especially for the making of well bores, said apparatus comprising a dynamic ram earth boring device (10) with a drive device (12) and a displacement head (14) arranged coaxial to the drive device (12), said displacement head having a longitudinal axis and being adapted to be placed on said front end of said pipe with its longitudinal axis collinear with said longitudinal axis of said pipe and with a portion thereof extending forwardly in the longitudinal direction of said pipe, said forwardly extending portion of said displacement head having a maximum diameter greater than said outside diameter of said pipe, and said drive device having a maximum outside diameter less than said internal diameter of said drive so as to be adapted to be receivable within said front end of said pipe and to be releasably engageable with said displacement head to exert a forward driving force on said displacement head, and a pressure fluid jet nozzle (18) carried by said displacement head (14) and pointed nearly forwardly in the longitudinal direction of said head, which fluid jet nozzle is connectable to a pressure fluid source providing pressurized fluid for said nozzle.

2. An apparatus according to claim 1, wherein a plurality of pressure fluid jet nozzles (18) are carried by said displacement head (14) and are located behind one another in the longitudinal direction of the displacement head (14).

3. An apparatus according to claim 2, wherein said fluid jet nozzles (18) have different jet angles relative to the longitudinal direction of the displacement head (14).

4. An apparatus according to claim 1, wherein an additional fluid jet nozzle (20) is carried by said displacement head and is directed at least nearly opposite to said forward longitudinal direction of said head.

5. An apparatus according to claim 1, wherein the displacement head (14) carries further fluid jet nozzles (22) which are directed outwardly perpendicular to said longitudinal axis of said displacement head (14).

6. An apparatus according to claim 1, wherein said pressure fluid jet nozzle is one of a plurality of nozzles carried by said displacement head, and means for controlling the pressure fluid delivery to each of said nozzles with respect to the pressure and/or amount of the pressure fluid.

7. An apparatus according to claim 1, wherein said pressure fluid jet nozzle is one of a plurality of pressure fluid jet nozzles carried by said displacement head, and means for adjusting the jet angle of each of said nozzles.

8. An apparatus according to claim 1, wherein said pressure fluid jet nozzle is one of a plurality of pressure fluid jet nozzles carried by said displacement head, the displacement head (14) is conical and has grooves (24) distributed symmetrically over its conical surface and about its longitudinal axis, in which grooves said fluid jet nozzles are located.

9. An apparatus according to claim 1, wherein said pressure fluid jet nozzle is one of a plurality of pressure fluid jet nozzles earned by said displacement head, and the displacement head (14) is stepped, so or to have in proceeding forwardly from said front end of said pipe successive longitudinal portions of decreasing diameters, and has grooves (24) distributed over it and arranged symmetrically about its longitudinal axis, in which grooves said fluid jet nozzles are located.

10. An apparatus according to claim 1, wherein said pressure fluid jet nozzle is one of a plurality of pressure fluid jet nozzles carried by said displacement head, said nozzles being connected to means providing pressure fluid flow channels running parallel to said longitudinal axis of said pipe between said drive device (12) and said pipe (16) or inside of said drive device (12), said channels at their ends opposite to the head being connected by flexible conductors with a pressure fluid source.

11. An apparatus according to claim 1, wherein said pressure fluid jet nozzle is one of a plurality of pressure fluid jet nozzles carried by said displacement head, and including control valves (28) for controlling the pressure fluid delivery to the individual fluid jet nozzles carried by said displacement head (14), said control valves being located in the displacement head.

12. An apparatus according to claim 1, wherein said pressure fluid jet nozzle is one of a plurality of pressure fluid jet nozzles carried by said displacement head, and including control valves (28) for controlling the pressure fluid delivery to the individual fluid jet nozzles carried by said displacement head, said control valves being located at the pressure fluid source.

13. An apparatus according to claim 1, wherein said pressure fluid jet nozzle is one of a plurality of pressure fluid jet nozzles carried by said displacement head, and including a sender built into the displacement head (14) to make possible a determination of the position of the earth boring device (10).

14. An apparatus according to claim 1, wherein said dynamic ram boring device (12) includes a housing connected with a watertight exhaust air conductor which conductor carries away the pressurized air necessary for driving the dynamic ram boring device (12).

15. An apparatus according to claim 1 wherein said pressure fluid jet nozzle (18) is one of a plurality pressure fluid jet nozzles (18) carded by said displacement head and all of which nozzles are pointed nearly forwardly in the longitudinal direction of said pipe and are distributed symmetrically around said longitudinal axis of said pipe.

* * * * *